United States Patent [19]

Jacobson et al.

[11] 4,414,997

[45] Nov. 15, 1983

[54] SIPHON

[76] Inventors: Jeff A. Jacobson, 22 Woodgrove, Irvine, Calif. 92714; Louis G. Valle, 7283 Pennway, Stanton, Calif. 90680

[21] Appl. No.: 163,708

[22] Filed: Jun. 27, 1980

[51] Int. Cl.[3] ..... F04F 10/00

[52] U.S. Cl. ..... 137/151; 137/146; 137/532; 137/533.17

[58] Field of Search ..... 137/142, 146, 151, 532, 137/533, 533.17, 534

[56] References Cited

U.S. PATENT DOCUMENTS

| | | | |
|---|---|---|---|
| 421,057 | 2/1890 | Schuberth | 251/347 X |
| 763,876 | 6/1904 | Geiger | 137/532 |
| 2,479,554 | 8/1949 | Bugg | 137/533 |
| 2,604,294 | 7/1952 | Tamminga | 137/151 X |
| 2,927,596 | 3/1960 | Carlson | 137/151 X |
| 3,771,544 | 11/1973 | Horvath | 137/151 |
| 3,978,886 | 9/1976 | Mathis | 137/533.17 X |

FOREIGN PATENT DOCUMENTS

| | | | |
|---|---|---|---|
| 1085123 | 1/1955 | France | 137/146 |

*Primary Examiner*—Gerald A. Michalsky

*Attorney, Agent, or Firm*—Poms, Smith, Lande & Rose

[57] ABSTRACT

A siphon for transferring fluid from a container to either another container at lower elevation or to a disposal area. The siphon includes a tube having an improved one way check valve which valve is inserted into the first container and, by merely shaking the tube up and down, fluid flows by gravity into the second container or disposal area. The valve includes a valve housing having a throughbore with one end of the housing coupled to the tube and the other end mating with an internal movable cup-shaped element to thereby prevent fluid flow past the element when seated in the other end of the valve housing while permitting fluid flow through the valve housing and into the tube when the element moves away from its seating position.

2 Claims, 5 Drawing Figures

SIPHON

BACKGROUND OF THE INVENTION

1. Field of the Invention

The invention relates to siphons; and, more particularly, to a siphon having an improved value whereby fluid may be transferred from one container to another or to a disposal area.

2. Description of the Prior Art

Many siphons have been suggested in the past for transferring fluid from one container to either another container or some other disposal means. There has been increased interest in such siphons in recent years due to the gas crisis. Many people have encountered a need to transfer gas from the tank of one car to a can for transmissal to the tank of another car. There is a health hazard by sucking on a tube to siphon gas or the like since one could swallow the gasoline. Other needs involve removing water or the like from clogged sinks, replacing water in aquariums, emptying water beds, washers, etc. Although many such siphons have been suggested, they have all proven unsatisfactory for various reasons. One such siphon is disclosed in U.S. Pat. No. 330,078 to Wittram. In such a siphon, the disc valve can cant during use rendering it inoperative. In U.S. Pat. No. 2,927,596 to Carlson, the flapper valve and opening of the siphon must be carefully machined to provide proper closure. Similar flapper valves with the same deficiencies are found in U.S. Pat. No. 290,561 to Flocker and U.S. Pat. No. 3,021,860 to Gandy. An elongated sidemounted flapper valve is found in U.S. Pat. No. 4,095,615 to Ramsauer. The Ramsauer device has limited use in an aquarium and is not practical for transferring fluid from one location to another. Further, the valve mechanism of Ramsauer is quite complex. Such a siphon as with the other prior devices will leak fluid when not siphoning.

There is a need for a siphon which can be safely inserted into a gas tank or the like which is formed of non-corrosive parts and may be inexpensively and easily manufactured. Such a siphon should be easy to use without sucking on the same or otherwise coming into contact with the fluid being siphoned and not leak when the siphon is pulled out of the tank or the like.

SUMMARY OF THE INVENTION

It is an object of this invention to provide a siphon having an improved valve.

It is still another object of this invention to provide a siphon which will not leak when the siphon is removed from the tank or the like.

It is another object of this invention to provide a siphon which includes few moving parts, can be made of non-corrosive parts, and is easy to use without the need for sucking or otherwise coming into contact with the fluid being siphoned.

These and other objects are preferably accomplished by providing a tube having an improved one way check valve which valve is inserted into the first container and, by merely shaking the tube up and down, fluid flows by gravity into the second container or disposal area. The valve includes a valve housing having a throughbore with one end of the housing coupled to the tube and the other end mating with an internal movable cup-shaped element to thereby prevent fluid flow past the element when seated in the other end of the valve housing while permitting fluid flow through the valve housing and into the tube when the element moves away from its seating position.

DESCRIPTION OF THE PREFERRED EMBODIMENT

Figure 1:
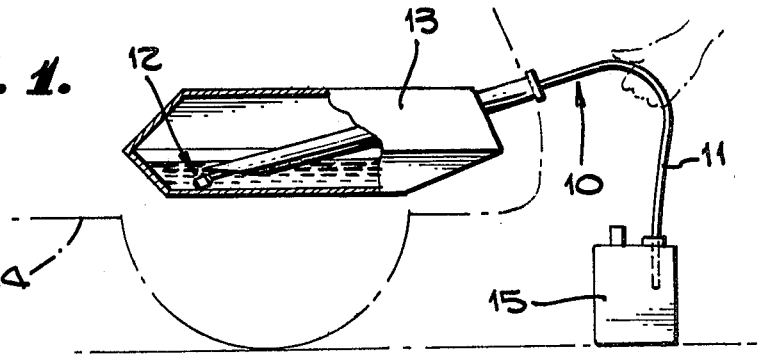
FIG. 1 is a vertical view, partly in section, of a siphon in accordance with the invention shown in operation.

Referring now to FIG. 1 of the drawing, a siphon 10 in accordance with the invention is shown. Siphon 10 preferably includes an elongated flexible tubular member 11 coupled to valve means 12. Preferably, member 11 is a hose or tube of a suitable material, such as plastic. For example, since one of the preferred uses of the siphon 10 is to transfer gasoline from the tank 13 of one vehicle 14 to a can 15 or the like, as shown in FIG. 1, tubing used for member 11 is preferably flexible and transparent gas-resistant vinyl material. Any suitable diameter tubing may be used, e.g., one having an I.D. of 0.375 inches, wall thickness of 0.055" and any suitable length, e.g. 6 to 7 feet.

Figure 2:
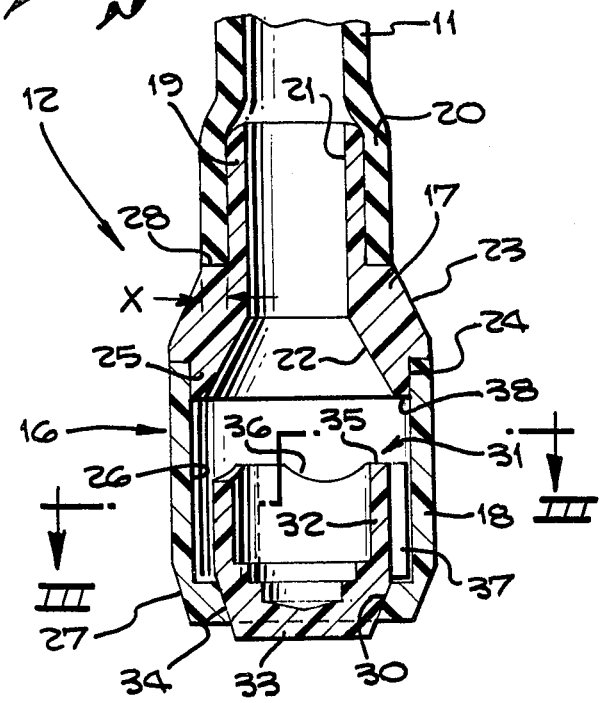
FIG. 2 is a vertical cross-sectional view taken through a portion of the lower end of the siphon on FIG. 1.

As particularly contemplated in the present invention, valve means 12 is provided for quickly and easily siphoning fluid from a container, without leaking the same when the siphon is removed, to another container or other remote location. In the exemplary embodiment of the invention, such valve means 12, as shown in FIG. 2, includes a valve body 16 which may comprise an upper body portion 17 and a lower body portion 18. Upper body portion 17 may be integral with lower body portion 18 and fixed thereto, as by ultrasonic welding or other suitable means, after assembly.

Upper body portion 17 includes a tubular nozzle 19 over which end 20 of tubing 11 may be inserted in a tight friction fit. Nozzle 19 has a smooth walled throughbore 21 opening into a flared chamber 22 forming the bottom of upper body portion 17. The outer configuration of body portion 17 forming inner chamber 22 is also flared or tapered as shown. The outer flared surface 23 is stepped or undercut at 24 forming an annular flange 25 with inner chamber 22. As can be seen, the lower body portion 18 is press-fit onto the outer surface of flange 25, the wall thickness thereof being substantially the same as the width of the undercut 24 to form a smooth outer surface for valve body 16.

Chamber 22 communicates with a smooth-walled throughbore 26 extending through lower body portion 18. The outer wall of lower body portion 18 flares or tapers inwardly at tapered portion 27 at the terminal end of valve means 12 so that the same can be inserted into tight spaces with minimum obstruction and resistance by the siphon 10.

The wall thickness of tubing 11, at least at end 20, is preferably related to the width x of the shoulder 28 formed at the junction of nozzle 19 and flared surface 23 to provide a smooth aerodynamic outer surface to tubing 11 and valve means 12. This provides for smooth insertion and withdrawal of siphon 10 into a gas tank or the like. If desired, the outer surface 29 of nozzle 19 may be ribbed or roughened to facilitate in holding tubing 11 on the nozzle 19.

Figure 4:
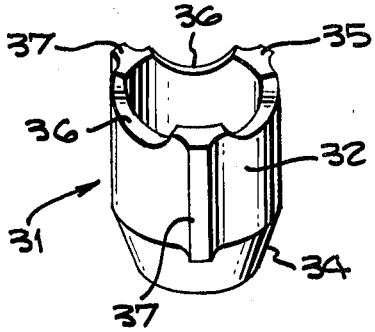
FIG. 4 is a perspective view of one of the components of the siphon of FIGS. 1 through 3.

As can be seen in FIG. 2, the inner wall 30 of the tapered portion 27 of lower body portion 18 is tapered inwardly as shown for reasons to be discussed. The remaining component of valve means 12 is a cup-shaped valve element 31 also shown in FIG. 4. Element 31 may include a generally cylindrical main body portion 32 closed at the bottom by imperforate bottom wall 33. The outer surface 34 of bottom wall 33 is tapered inwardly and conforms to the inward taper of wall 30 to provide a relatively tight fit between element 31 and valve body portion 18 at the opening at the bottom thereof. For example, both surfaces 30, 34 may be at about 45° angles. Further, it can be seen that the lower end of element 31 preferably extends beyond the lowermost surface of body portion 18. That is, the dimensions of walls 30 and 34 are preselected so a relatively tight fit is provided but element 31 protrudes out of body portion 18 as shown. This enables element 31 to be hit or struck, e.g., holding the upper end of tubing 11 and striking valve means 12 against the bottom of tank 13 in FIG. 1 will dislodge element 31 should it stick or clog. Of course, element 31 could have its bottom wall 33 flush with the bottom of portion 18 if desired.

Figure 3:
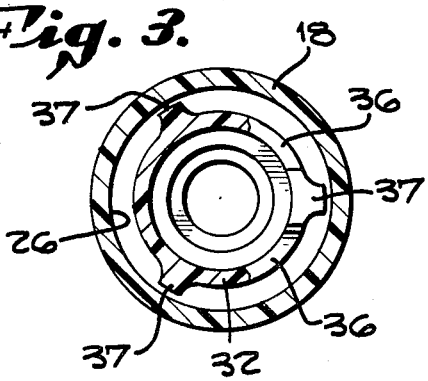
FIG. 3 is a view taken along lines III—III of FIG. 2.

The upper wall 35 of element 31 includes a plurality of spaced arcuate cut-out sections 36 and a plurality of spaced fins 37 are provided on the outer wall thereof. As shown in FIG. 3, fins 37 space element 31 away from inner wall or bore 26 of body portion 18 for both proper alignment and to prevent cocking while permitting maximum fluid flow about element 31, as will be discussed.

Figure 5:
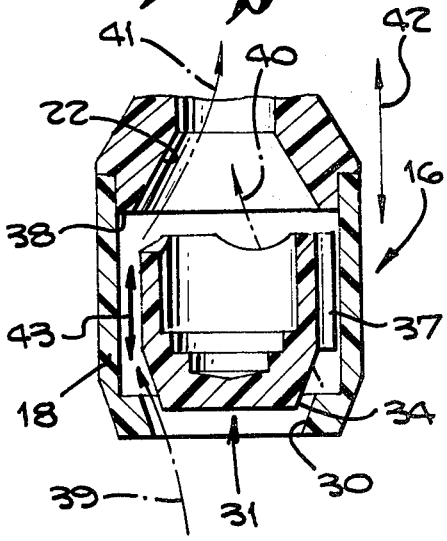
FIG. 5 is a vertical section view of the valve of the siphon showing the operation thereof.

As can be seen in FIGS. 2 and 5, the outer diameter of the upper wall 35 of element 31, with fins 37, is greater than the inner lowermost diameter of the chamber 22 so that element 31 will abut against lower wall 38 (FIG. 5) during its upward movement. As can be seen in FIG. 5, fluid enters valve means 12 via arrow 39 through the opening formed by tapered inner wall 30 (when element 31 is moved upwardly as shown and as will be discussed) and flow via arrows 40, 41 about and between arcuate portions 36 up through nozzle 19 into tubing 11. That is, since element 31 abuts against wall 38 as it moves upwardly, it would seal with the wall 38 and no fluid flow would take place unless openings, such as arcuate portions 36, are provided.

Referring once again to FIG. 1, in operation, the valve means 12 is inserted into the container, such as tank 13, from which it is desired to remove or transfer fluid, such as gas. The tubing 11 is held as shown with the free end terminating in a can 15, or other disposal means, at a lower level then tank 13. By merely shaking tubing 11 up and down, the element 31 (see also FIG. 5) moves up and down in the valve body 16, as indicated by arrow 43 with fluid thus entering valve body 16 through opening 30, as indicated by arrow 39, and up through tubing 11. As more and more fluid enters tubing 11, the weight of fluid in the tubing 11 enters element 31 and, because of its cup-shaped configuration, enters the cup or cavity portion 43 and weights it down so that wall 34 seals with wall 30 (FIG. 2) preventing leakage when shaking of siphon 10 is stopped momentarily. This shaking action is continued until sufficient fluid enters tubing 11 so that gravity takes over, due to the difference in elevation, and fluid begins to flow into can 15. This gravity flow will retain element 31 in the FIG. 5 position allowing smooth continuous flow. When it is desired to stop such flow, tubing 11 is merely lifted out of tank 13 and any fluid in the tubing 11 can be poured into either tank 13 or can 15. Should element 31 get stuck, it is a simple matter merely to hit the protruding portion thereof on the bottom of tank 13 to unstick the same. When the tubing 11 is lifted out of tank 13, element 31 seals in opening 30, as shown in FIG. 2, preventing leakage, and the valve means 12 can be held while inverting tubing 11 to pour out the contents thereof.

The siphon described can be used to empty aquariums when it is desired to change or clean the water, clogged sinks, washers, water beds, boats, etc. Merely changing the size of the tubing and valve means would enable the siphon to have broader applications, such as bailing out boats. An ordinary garden hose can be used in place of tubing 11 with the hose threading onto like threads provided on nozzle 19. Optionally, a threaded insert may be provided for insertion into the free end of tubing 11 to threadably connect to a hose or the like.

Any suitable materials, such as vinyl tubing and present day plastics, may be used for the various components. It can be seen that we have disclosed a siphon having an improved valve which can be quickly and easily be used to transfer fluid from one place to another without sucking or otherwise coming into contact with the fluid being siphoned.

We claim:

1. In a self-contained portable siphon having a flexible tubing and a valve, said valve having a freely movable valve element therein, said valve comprising a valve body having a throughbore with a valve seat in the bottom wall thereof, said valve element having a bottom wall substantially conforming to said valve seat to provide a generally fluid tight seal between said element and said seat, the improvement which comprises:

said valve seat having tapered walls;

said valve element being loosely disposed in said valve and consisting of a generally cup-shaped body having a throughbore closed off by an imperforate bottom wall integral with an imperforate peripheral side wall tapered similarly to the tapered walls of said valve seat and spacing means including a plurality of spaced fins extending along the outer wall of said cup-shaped body in a direction generally parallel to the longitudinal axis thereof spacing said cup-shaped body away from the inner wall of said valve body thereby forming a cup-shaped cavity on said element adapted to hold fluid therein whereby fluid entering said valve body enters the cavity in said element and weighs down said element into said valve seat pressing the tapered side wall of said element against the tapered wall of said valve seat to provide said seal;

stop means on the inner wall of said valve body for stopping upward movement of said valve element including an inner flange in said valve body surrounding said throughbore for stopping upward movement of said valve element and wherein said element includes an upper peripheral wall and the outer diameter of the wall of said element is substantially as large as the area of said throughbore at said inner flange whereby said element abuts against the inner flange when it moves upwardly thereagainst; and a plurality of spaced arcuate-shaped cut-out areas in said element about the periphery of the upper wall thereof providing fluid flow past said element through said cut-out areas and into said tubing.

2. In the siphon of claim 1 wherein at least a portion of said element protrudes out of said valve body.

* * * * *